US010682659B2

(12) United States Patent
Sulzer et al.

(10) Patent No.: US 10,682,659 B2
(45) Date of Patent: Jun. 16, 2020

(54) SPRAY HEAD FOR A PAINT SPRAYER, AND PAINT SPRAYER

(71) Applicant: J. Wagner GmbH, Markdorf (DE)

(72) Inventors: Christopher J. Sulzer, St. Louis Park, MN (US); Jan Barthelmes, Salem (DE)

(73) Assignee: J. Wagner GmbH, Markdorf (DE)

( * ) Notice: Subject to any disclaimer, the term of this patent is extended or adjusted under 35 U.S.C. 154(b) by 17 days.

(21) Appl. No.: 15/892,466

(22) Filed: Feb. 9, 2018

(65) Prior Publication Data

US 2018/0236471 A1 Aug. 23, 2018

(30) Foreign Application Priority Data

Feb. 17, 2017 (DE) ..... 10 2017 103 335

(51) Int. Cl.
*B05B 7/08* (2006.01)

(52) U.S. Cl.
CPC ..... *B05B 7/0815* (2013.01); *B05B 7/083* (2013.01); *B05B 7/0823* (2013.01); *B05B 7/0861* (2013.01)

(58) Field of Classification Search
CPC ..... B05B 7/0815; B05B 7/0823; B05B 7/083; B05B 7/0861
USPC ..... 239/296–299, 408, 413–415, 416.4, 239/416.5, 417.3, 417.5, 423, 424
See application file for complete search history.

(56) References Cited

U.S. PATENT DOCUMENTS 2,070,695 A 2/1937 Tracy
4,171,096 A 10/1979 Welsh et al.
5,435,491 A * 7/1995 Sakuma ..... B05B 7/0815 239/296
2014/0077002 A1 3/2014 Krayer

FOREIGN PATENT DOCUMENTS

DE 28 22 687 A1 12/1978
DE 10 2011 100 806 A1 11/2012
FR 985544 A 7/1951

OTHER PUBLICATIONS

German Search Report (Application No. 10 2017 103 335.1) dated Sep. 5, 2017.

* cited by examiner

*Primary Examiner* — Christopher S Kim
(74) *Attorney, Agent, or Firm* — Burr & Brown, PLLC

(57) ABSTRACT

The present invention relates to a spray head for a paint sprayer, in particular a paint spray gun or a paint spray lance, for generating a paint jet. Here, an air cap comprises two curtain air channels whose outlets are arranged between air horns, and whose outlets lie opposite each other in relation to a longitudinal axis of a through-opening of the air cap.

14 Claims, 10 Drawing Sheets

SPRAY HEAD FOR A PAINT SPRAYER, AND PAINT SPRAYER

This application claims the benefit under 35 USC § 119(a)-(d) of German Application No. 10 2017 103 335.1 filed Feb. 17, 2017, the entirety of which is incorporated herein by reference.

FIELD OF THE INVENTION

The present invention relates to a spray head for a paint sprayer and a paint sprayer.

BACKGROUND OF THE INVENTION

DE 10 2011 100 806 A1 discloses a spray head for a paint sprayer for generating a paint jet, wherein the spray head comprises an air gate, an air cap and a needle, wherein the air cap is arranged downstream from the air gate in the air flow direction, wherein the needle is arranged upstream from the air gate in the air flow direction, wherein the air gate comprises a centrally arranged paint outlet opening and air outlet openings, wherein a paint nozzle is formed by the paint outlet opening and, with the needle, forms a needle valve, wherein the air cap has a centrally arranged through-opening of elongate cross section for the passage of the paint jet or of the paint nozzle and for the passage of a stream of sheathing air surrounding the paint jet or the paint nozzle, wherein the through-opening is oriented with a longitudinal axis and a transverse axis transversely with respect to a central axis of the spray head running in the air flow direction, wherein the air cap comprises two air horns which protrude past its through-opening in the air flow direction and lie opposite each other in relation to the transverse axis of its through-opening, wherein the air horns each comprise at least one horn air channel which is directed toward the paint jet emerging from the paint outlet opening, and wherein the horn air channels of the air horns can be supplied with air via at least one of the air outlet openings of the air gate.

SUMMARY OF THE INVENTION

The object of the present invention is to propose a spray head for a paint sprayer, and also a paint sprayer, each of which is suitable for generating a paint jet which is configured, in particular, as a flat jet and which has an improved spray pattern in terms of particle distribution.

In the spray head according to the present invention, provision is made that the air cap comprises two curtain air channels whose outlets are arranged between the air horns, and whose outlets lie opposite each other in relation to the longitudinal axis of the through-opening of the air cap. By means of curtain air channels arranged in this way, the paint jet can be shaped and focused even in regions that are not covered or are only weakly covered by streams of horn air from the air horns, and/or it is possible to counteract excessive flattening of the paint jet by the streams of horn air. A spray pattern is thus generated in which a surface portion in which the spray pattern has a uniform particle distribution is enlarged, and in which a surface portion in which the spray pattern has a changing particle distribution is made smaller. Curtain air channels of this kind can be easily arranged, in sufficient size, with their outlets located laterally with respect to the central through-opening of the air cap.

Furthermore, provision is made that the spray head comprises a control disk, wherein the control disk is arranged between the air gate and the air cap and is rotatable about the central axis of the spray head with respect to the air gate and the air cap or is rotatable together with the air cap with respect to the air gate, in particular through 90° about the central axis of the spray head. In this way, the delivery of air can be controlled specifically for different cases of use. The rotatability of the air cap through 90° or other angles makes work with a paint jet configured as a flat jet much easier for a user, since it is not necessary to hold the spray head obliquely in order to change an orientation of the paint jet.

Provision is also made that the outlets of the curtain air channels and/or the curtain air channels are arranged with mirror symmetry to the longitudinal axis of the through-opening of the air cap. In this way, it is possible to exert a planar and not just a linear influence on mutually opposite regions of the paint jet.

Furthermore, provision is made that the outlets of the curtain air channels each have an outlet length which is measured parallel to the longitudinal axis of the through-opening and which is at least 25% and at most 120% and, in particular, 70% to 90% of a length of the longitudinal axis of the through-opening, and that the outlets of the curtain air channels each have an outlet width which is measured parallel to the transverse axis of the through-opening, wherein the outlet width is at most 60% and, in particular, at most 50% of the outlet length. Such dimensioning of the outlets allows the paint jet to be efficiently influenced and shaped in those regions that are not covered or are only weakly covered by the jets of horn air.

Provision is also made that the outlets of the curtain air channels, viewed in the direction of the central axis of the spray head, each have an arc-shaped profile, wherein the outlets of the curtain air channels are curved about the central axis of the spray head. This ensures that the two generated streams of curtain air are adapted to the cross-sectional shape of the emerging paint jet and can thus act early on the paint jet with their entire width.

According to one embodiment variant, provision is made that the curtain air channels generate streams of curtain air oriented parallel to the central axis of the spray head, wherein provision is made, in particular, for this purpose that the curtain air channels each have, toward their outlet, at least one side wall portion which is oriented parallel to the central axis of the spray head. With streams of curtain air thus oriented, the paint jet can be influenced moderately.

According to a further embodiment variant, provision is made that the curtain air channels generate streams of curtain air directed toward the central axis, wherein provision is made, in particular, for this purpose that the curtain air channels each have, toward their outlet, at least one side wall portion which is tilted in the air flow direction toward the central axis of the spray head. With streams of curtain air thus oriented, the paint jet can be influenced strongly.

In a third embodiment variant, provision is made that the curtain air channels generate streams of curtain air directed away from the central axis, wherein provision is made, in particular, for this purpose that the curtain air channels each have, toward their outlet, at least one side wall portion which is tilted in the air flow direction away from the central axis of the spray head. With streams of curtain air thus oriented, the paint jet can be influenced weakly.

Provision is also made that the control disk comprises at least one aperture for sheathing air, wherein the aperture for sheathing air, is in particular, arranged centrally in the control disk, and/or the control disk comprises at least one aperture for horn air, wherein the at least one aperture for horn air is, in particular, arranged eccentrically in the control disk, and/or the control disk comprises at least one aperture for curtain air, wherein the aperture for curtain air is either arranged, in particular, centrally in the control disk or, in particular, eccentrically in the control disk, and, in the case of an eccentric arrangement of the aperture for curtain air, provision is, in particular, made that an inlet of the curtain air channel is arranged radially farther away from the central axis of the spray head than an outlet of the curtain air channel is arranged from the central axis of the spray head, and/or the control disk, in particular, comprises at least one aperture for compensating air, wherein the at least one aperture for compensating air is, in particular, arranged eccentrically in the control disk. In this way, despite a technically uncomplicated structure, the paint spray head can be easily controlled and switched by rotation of the control disk.

Furthermore, provision is made that the at least one aperture for horn air and the at least one aperture for compensating air and the at least one aperture for curtain air are arranged on the control disk in such a way that, in a first rotation position adopted by the control disk relative to the air cap, air flows out of the horn air channels, relief bores for compensating air that are optionally present in the air cap are cut off from the air stream, and air flows out of the curtain air channels or, in a second rotation position adopted by the control disk relative to the air cap, air flows out of the horn air channels, air flows out of relief bores for compensating air that are optionally present in the air cap, and the curtain air channels are cut off from the air stream or, in a third rotation position adopted by the control disk relative to the air cap, the horn air channels are cut off from the air stream, air flows out of relief bores for compensating air that are optionally present in the air cap, and air flows out of the curtain air channels. In this way, the streams of horn air and the streams of curtain air can be activated independently of each other or jointly, without the switching-on or the switching-off of the streams of horn air or the streams of curtain air substantially influencing the streams of curtain air and streams of horn air, respectively, such that the streams of horn air and the streams of curtain air work constantly irrespective of whether the streams of curtain air or streams of horn air are activated or not.

Provision is also made that two of the apertures of the control disk are dimensioned such that one of the horn air channels and one of the relief bores can be supplied through these, respectively. In this way, the mechanism needed to switch between the three operating stages is simplified in such a way that a control disk is sufficient to do this.

Provision is also made that a length of the longitudinal axis of the centrally arranged through-opening of the air cap is at least 30% longer than a width, measured in the direction of the transverse axis, of the eccentrically arranged through-opening of the air cap. It is, in particular, with a through-opening of such dimensions that the desired spray patterns can be generated with the curtain air channels according to the invention.

Provision is also made that the spray head comprises a body and a union nut, wherein the needle is guided longitudinally displaceably in the body, wherein the body comprises a seat for the air gate, wherein the body comprises, in the region of the seat, an attachment means on which the union nut can be secured in such a way that the air horn and the optionally present control disk and the air gate are held on the body, wherein provision is, in particular, made that the spray head comprises a rotary actuator by which the air cap is rotatable, and wherein provision is, in particular, made that the spray head comprises a slide which is guided in particular on the rotary actuator and by means of which the control disk is rotatable. A construction of this kind allows an easy-to-understand operation of the spray head for the user.

The present invention further relates to a paint sprayer, in particular, a paint spray gun or paint spray lance, comprising a spray head, a paint supply and an air supply. In this way, a paint sprayer is formed which has the abovementioned advantages.

Finally, a paint sprayer is provided in which the body of the spray head comprises attachment means for the paint supply, to which means the paint supply is attached, and the body of the spray head comprises attachment means for the air supply, to which means the air supply is attached, and the body comprises a trigger by which a spray function of the paint sprayer can be controlled. A paint sprayer of this kind can be used in many different ways.

BRIEF DESCRIPTION OF THE DRAWINGS

Further details of the present invention are described on the basis of illustrative embodiments shown schematically in the drawing, in which.

DETAILED DESCRIPTION OF THE PRESENT INVENTION

Figure 1A:
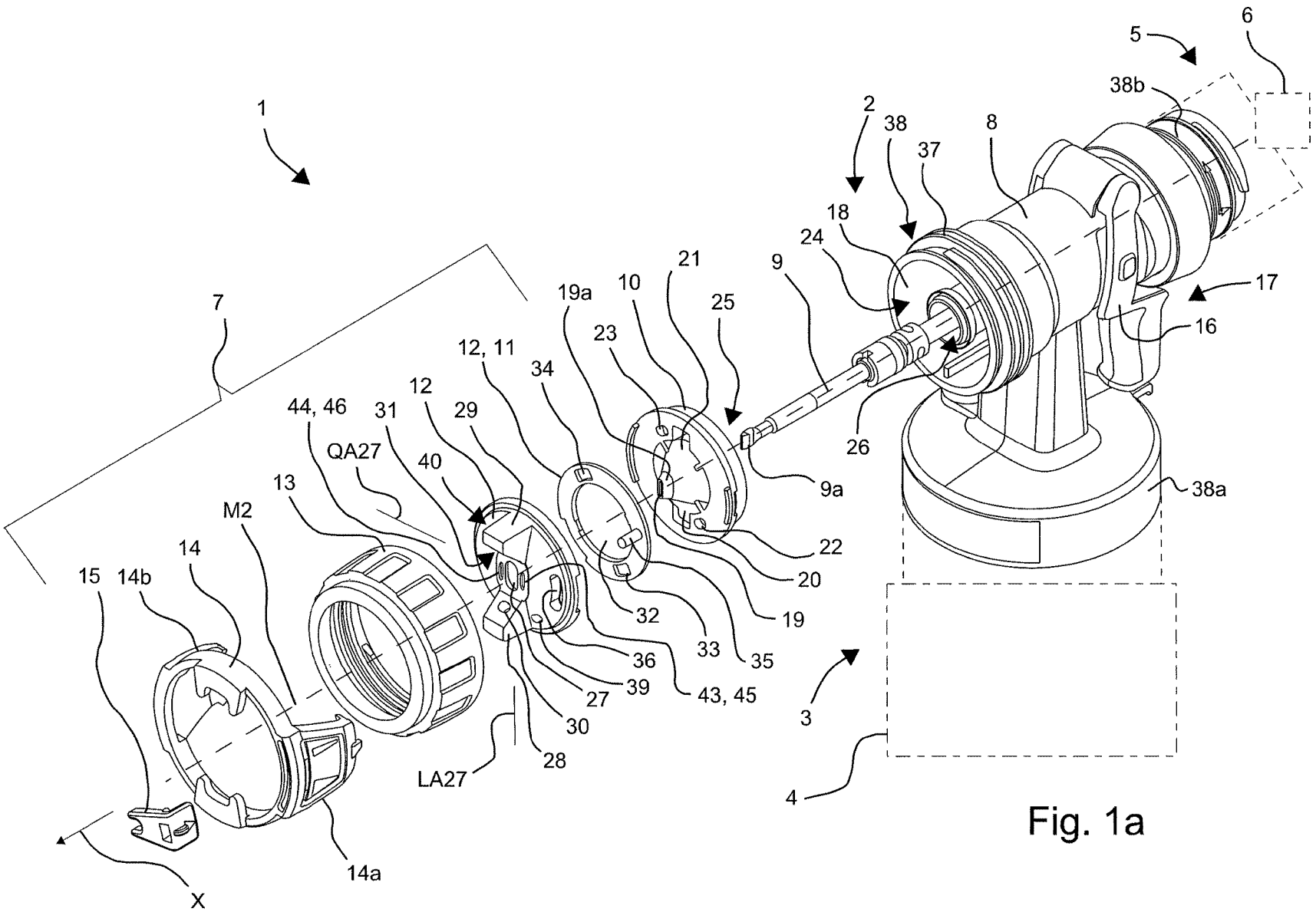
FIG. 1*a* shows an exploded view of a paint sprayer comprising a spray head.
Figures 1B, 1C:
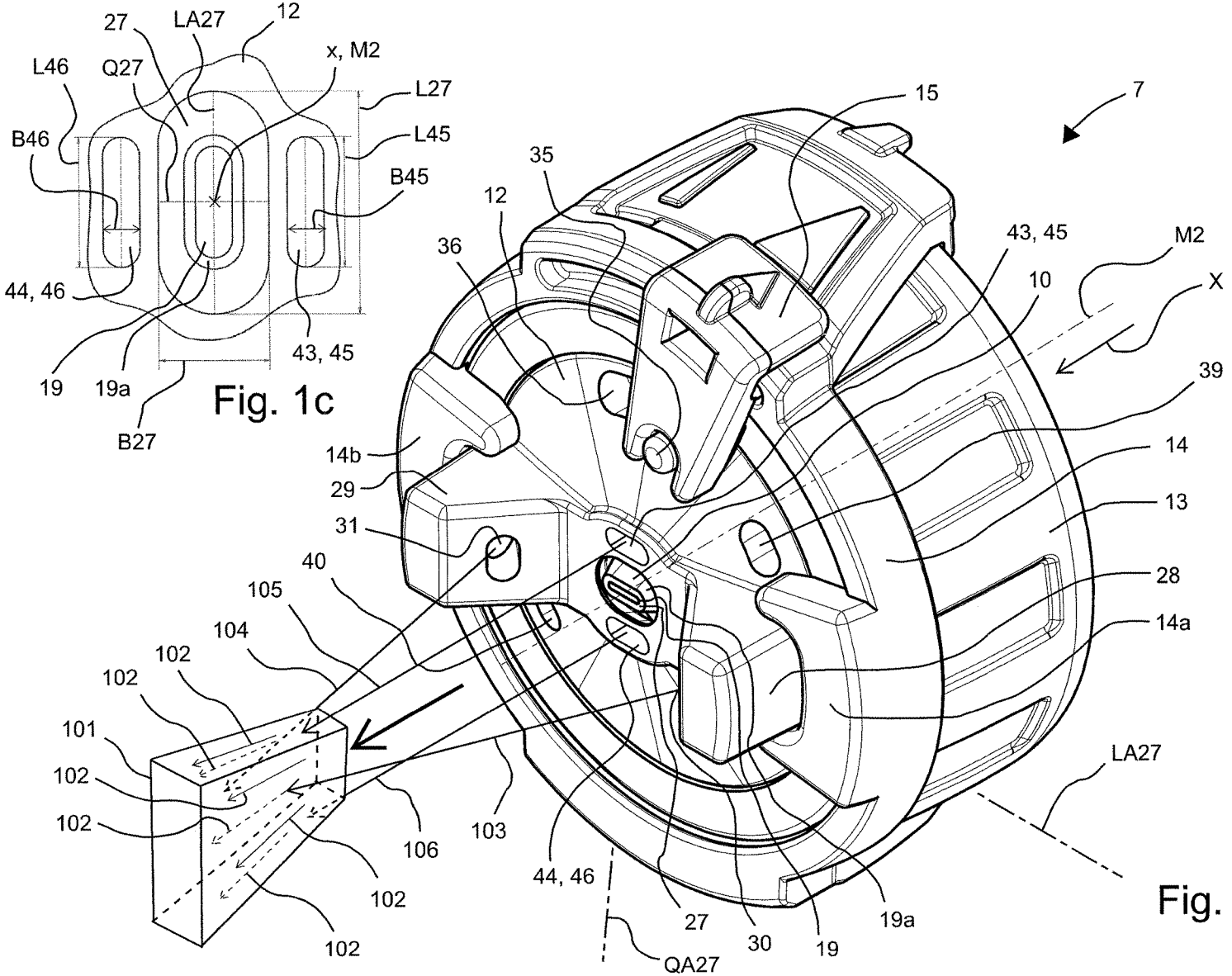
FIG. 1*b* shows a perspective view of a group of components from FIG. 1*a* in the assembled state.
FIG. 1*c* shows a plan view of the depiction in FIG. 1*b;*

FIG. 1*a* is an exploded view showing a paint sprayer 1 comprising a spray head 2. A paint supply 3, which is attached to the spray head 2 and comprises a container 4, is shown schematically. An air supply 5, which comprises a fan 6, is likewise depicted schematically. FIG. 1*b* shows a perspective view of a group of components 7 from FIG. 1*a* in the assembled state. The paint sprayer 1 and the spray head 2 serve to generate a paint jet 101 (see FIG. 1*b*), wherein the paint jet 101 is shown only in part and in transparent form. The paint sprayer 1 is designed, in particular, as a paint spray gun or as a paint spray lance. Accordingly, the paint supply and the air supply are attached directly to the spray head or each comprise hoses via which they are connected to the spray head.

As can be seen from FIG. 1*a*, the spray head 2 comprises a body 8, a needle 9, an air gate 10, a control disk 11, an air cap 12, a union nut 13, a rotary actuator 14 and a slide 15. Here, the air gate 10, the control disk 11, the air cap 12, the union nut 13, the rotary actuator 14 and the slide 15 form the group of components 7, shown in the assembled state in FIG. 1*b*. Viewed in an air flow direction x, the air cap 12 is arranged downstream from the air gate 10, and the control disk 11 is arranged between the air cap 12 and the air gate 10. The needle 9 is received in the body 8 so as to be longitudinally displaceable on a central axis M2 of the spray head 2 running in the air flow direction x and so as to be able to be actuated by means of a trigger lever 16 of the trigger 17. In the region of the needle 9, the body 8 has a seat 18 for the air gate 10, such that the needle 9 and the air gate 10 are oriented with respect to each other in the assembled state of the spray head 2. The air gate 10 comprises a centrally arranged paint outlet opening 19 and air outlet openings 20, 21, 22 and 23. A paint nozzle 19*a* is formed by the paint outlet opening 19 on the air gate 10. The air outlet openings 20 to 23 are supplied with air from the air supply 5 via a ring-shaped air supply channel 24 formed in the body 8. The paint outlet opening 19 of the air gate 10 and a head 9*a* of the needle 9 form a needle valve 25. The needle valve 25 is supplied with paint from the paint supply 3 via a paint supply channel 26 formed in the body 8. The needle 9 is also received in this paint supply channel 26. The air cap 12 has a centrally arranged through-opening 27 of elongate cross section for the passage of the paint nozzle 19*a* of the air gate 10 and for the passage of a stream of sheathing air 102 surrounding the paint outlet opening 19 (see FIG. 1*b*). The stream of sheathing air 102 is indicated by a group of short arrows which surround the paint jet 101. The stream of sheathing air 102 is also designated as an atomizer air stream, since it ensures the basic formation of the paint jet. The through-opening 27 is oriented with a longitudinal axis LA27 and a transverse axis QA27 transversely with respect to the central axis M2 of the spray head 2 running in the air flow direction x. The longitudinal axis LA27 and the transverse axis QA27 are depicted in FIG. 1*c*, which shows a schematic plan view of the air cap depicted in FIGS. 1*a* and 1*b*, wherein the air flow direction x points outward from the drawing plane. For reasons of space, FIGS. 1*a* and 1*b* show the longitudinal axis LA27 and the transverse axis QA27 only schematically in terms of their orientation. Moreover, the air cap 12 comprises two air horns 28, 29 which protrude past its through-opening 27 in the air flow direction x. They lie opposite each other in relation to the transverse axis QA27 of their through-opening 27. The air horns 28, 29 each comprise a horn air channel 30, 31, respectively, which is directed toward the paint jet 101 emerging from the paint outlet opening 19. Thus, streams of horn air 103 and 104 (indicated schematically by arrows) are deflected to the paint jet 101 and press the latter flat. Here, the horn air channels 30, 31 of the air horns 28, 29 can be supplied with air via at least one of the air outlet openings 20 to 23 of the air gate 10. The control disk 11 is designed as an annular disk 12 and has a central aperture 32, and two apertures 33 and 34 which are arranged eccentrically in relation to the central axis M2 and via which the horn air channels 30, 31 are supplied. Moreover, the control disk 11 comprises a pin-shaped extension piece 35 which protrudes in the air flow direction x and which, in the assembled state of the group of components 7, is guided through an arc-shaped oblong hole 36 in the air cap 12. The slide 15, which is guided on the rotary actuator 14, then engages on the extension piece 35 of the control disk 11. The rotary actuator 14 in turn sits on the union nut 13 rotatably about the central axis M2, by means of which union nut 13 the air gate 10, the control disk 11 and the air cap 12 are secured in the assembled state on an attachment means 38 of the body 8, the attachment means 38 being configured as a thread 37. By means of the slide 15, the control disk 11 can be rotated with respect to the air cap 12 and to the air gate 10.

The paint supply 3 is attachable to the body 8 via attachment means 38*a*, and the air supply 5 is attachable to the body 8 via attachment means 38*b*.

The air cap 12 is gripped at its air horns 28, 29 by the drivers 14*a*, 14*b* of the rotary actuator 14. In addition to the air horns 28, 29, the air cap 12 also comprises two relief bores 39, 40 through which air can flow off without influencing the paint jet 101. By rotation of the control disk 11, these relief bores 39, 40 are always supplied with air when, by rotation of the control disk 11 about the central axis M2, the air horns 28, 29 are blocked in the position shown in FIG. 1*a*. In this position of the control disk 11 shown in FIG. 1*a*, the air then flows through the air outlet openings 22, 23 of the air gate 10 and the apertures 33, 34 of the control disk 11 into and through the relief bores 39, 40.

If the control disk 11 is rotated clockwise about the central axis M2 by approximately 30° from the position shown in FIG. 1*a*, the relief bores 39, 40 of the air cap are closed by the control disk 11 and shut off from the air stream, and air flows through the air outlet openings 20, 21 of the air gate 10 and the eccentric apertures 33, 34 of the control disk 11 into the horn air channels 30, 31 of the air horns 28, 29.

The needle 9 is designed in two parts and comprises a front part 41, carrying the head 9*a*, and a rear part 42, which are rotatable relative to each other about the central axis M2. Thus, the air cap 12 can be rotated 90° clockwise or counterclockwise about the central axis M2 by the rotary actuator 14 entraining the control disk 11, the air gate 10 and the head 9*a* or front part 41 of the needle 9. By means of such rotation, the paint jet 101, which is configured as a flat jet, likewise acquires an orientation in space rotated through 90°. For special applications, rotation is also possible about any other desired angle. The needle head 9*a* is entrained by the air gate 10 in the rotation by means of the rotary actuator 14, since the latter is adapted in shape to the paint outlet opening 19 which, in contrast to a rotationally symmetrical configuration, has a shape resembling a blade of a flat-slot screwdriver.

To be able to configure the paint jet 101 with a sharp edge all the way round, the air cap 12 moreover comprises two curtain air channels 43, 44 whose outlets 45, 46 are arranged between the air horns 28, 29 and which lie opposite each other in relation to the longitudinal axis LA27 of the through-opening 27 of the air cap 12. The curtain air channels 43, 44 are supplied with air via the air outlet openings 20, 21 of the air gate 10 and the central aperture 32 of the control disk 11. The through-opening 27 is also supplied in this way, the through-opening 27 surrounding the paint outlet opening 19 like a ring in the assembled state of the group of components 7.

A stream of curtain air 105, 106 flows out of each of the outlets 45, 46 of the curtain air channels 43, 44. Accordingly, in the switch position in which the control disk 11 is held by the slide 15 in the view in FIG. 1*b*, the paint jet 101 is circumferentially sheathed or enclosed not only by a stream of sheathing air 102 emerging from the through-opening 27 but also enclosed or sheathed by the stream of horn air 103, the stream of curtain air 106, the stream of horn air 104 and the stream of curtain air 105. In the switch position in which the control disk 11 is held at its extension piece 35 by the slide 15 in the view in FIG. 1*b*, the relief bores 39, 40 of the air cap 12 are closed. Upon counterclockwise rotation of the control disk 11 through approximately 30° by means of the slide 15, the horn air channels 30, 31 can close and the relief bores can open. In this switch position of the control disk 11, the curtain air channels 43, 44 also continue to be supplied with air exactly like the through-opening 27.

As can be seen from FIG. 1*c*, the through-opening 27 has a length L27 measured in the direction of its longitudinal axis LA27, and a width B27 measured in the direction of its transverse axis QA27. The outlets 45 and 46, which are elongate in the plan view of the air cap 12, each have an outlet length L45, L46, respectively, measured parallel to the longitudinal axis LA27 of the through-opening 27, and each have an outlet width B45, B46, respectively, measured parallel to the transverse axis QA27 of the through-opening 27.

Figure 2A:
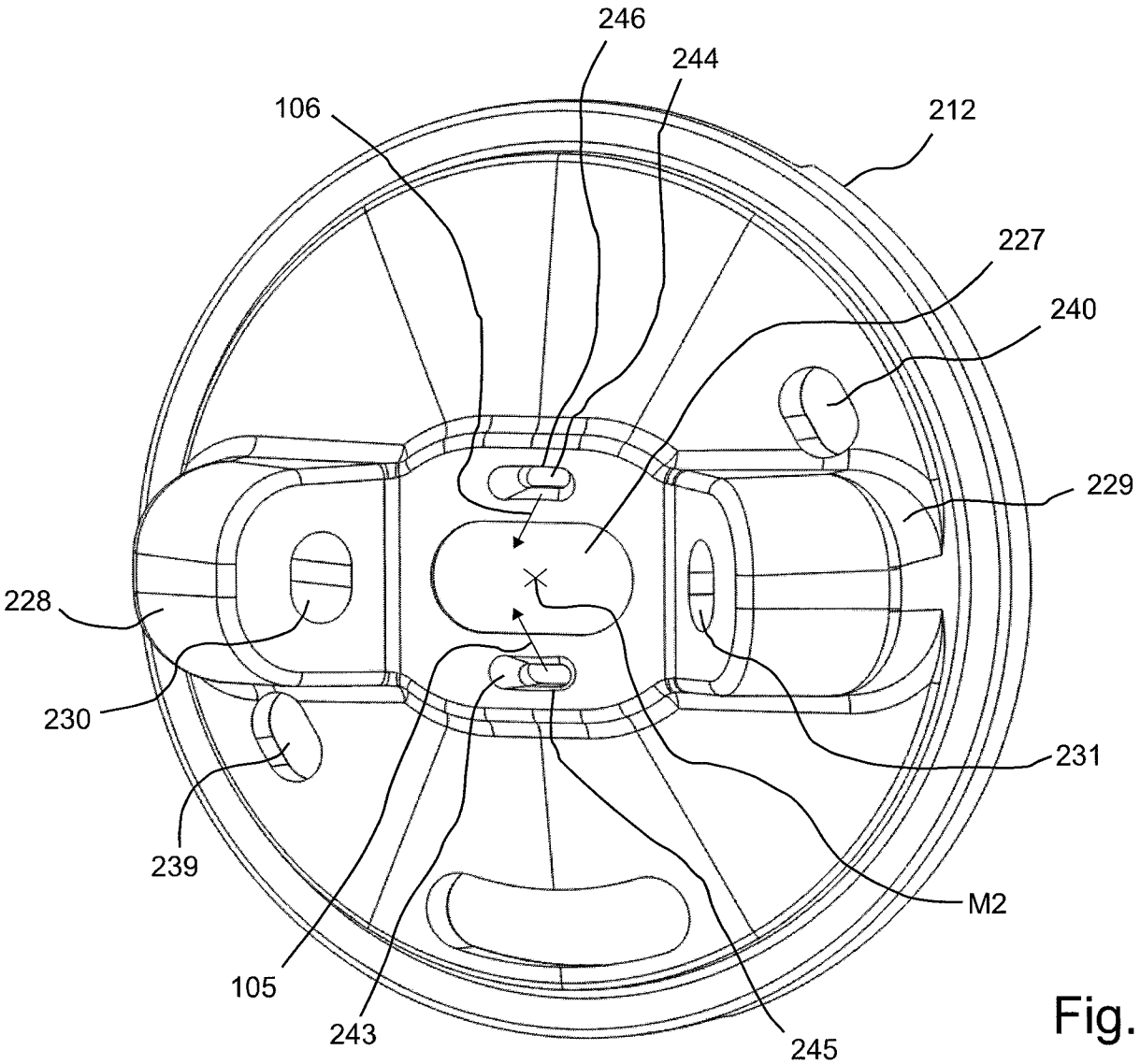
FIGS. 2*a*-2*c* show perspective views of a second embodiment of the present invention of an air cap for the spray head shown in FIGS. 1*a* to 1*c;*
Figure 2B:
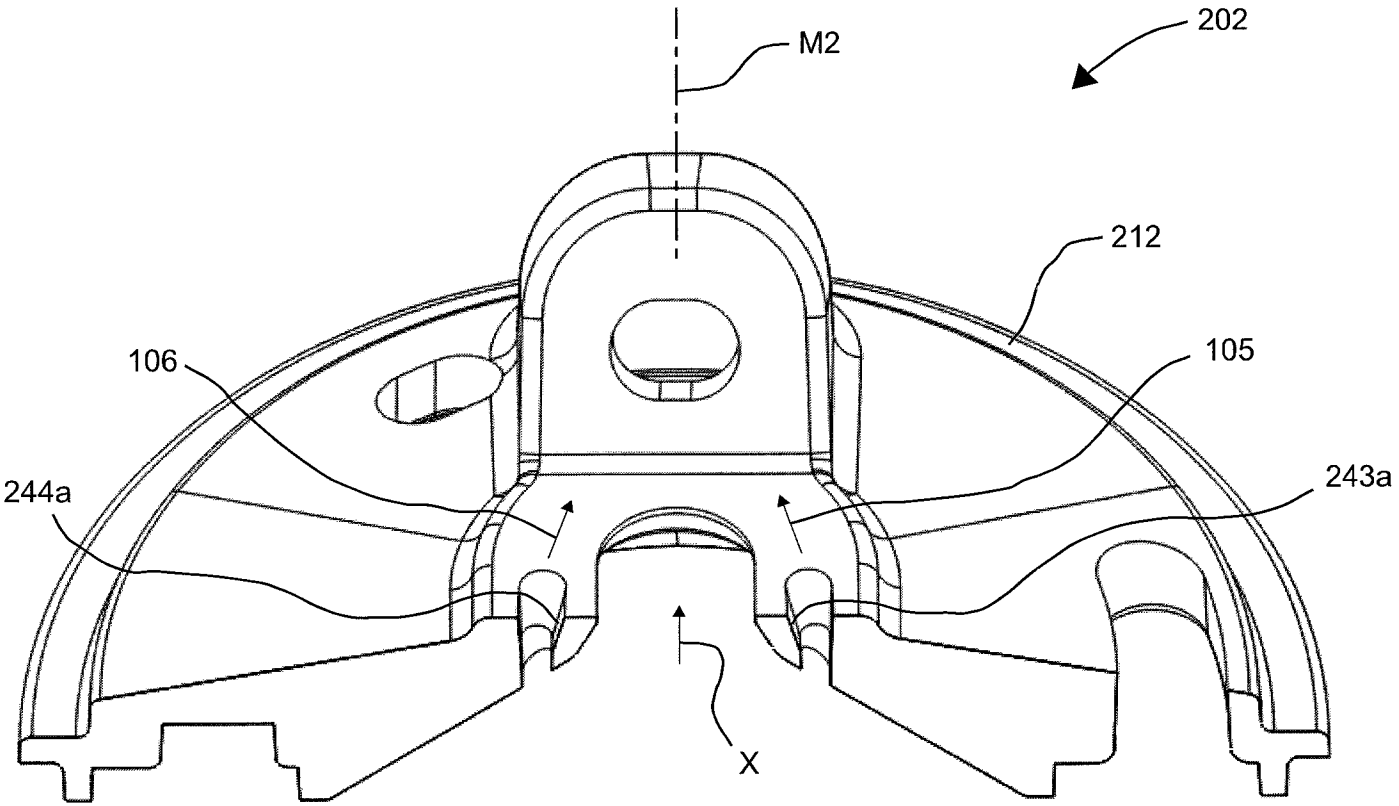
Figure 2C:
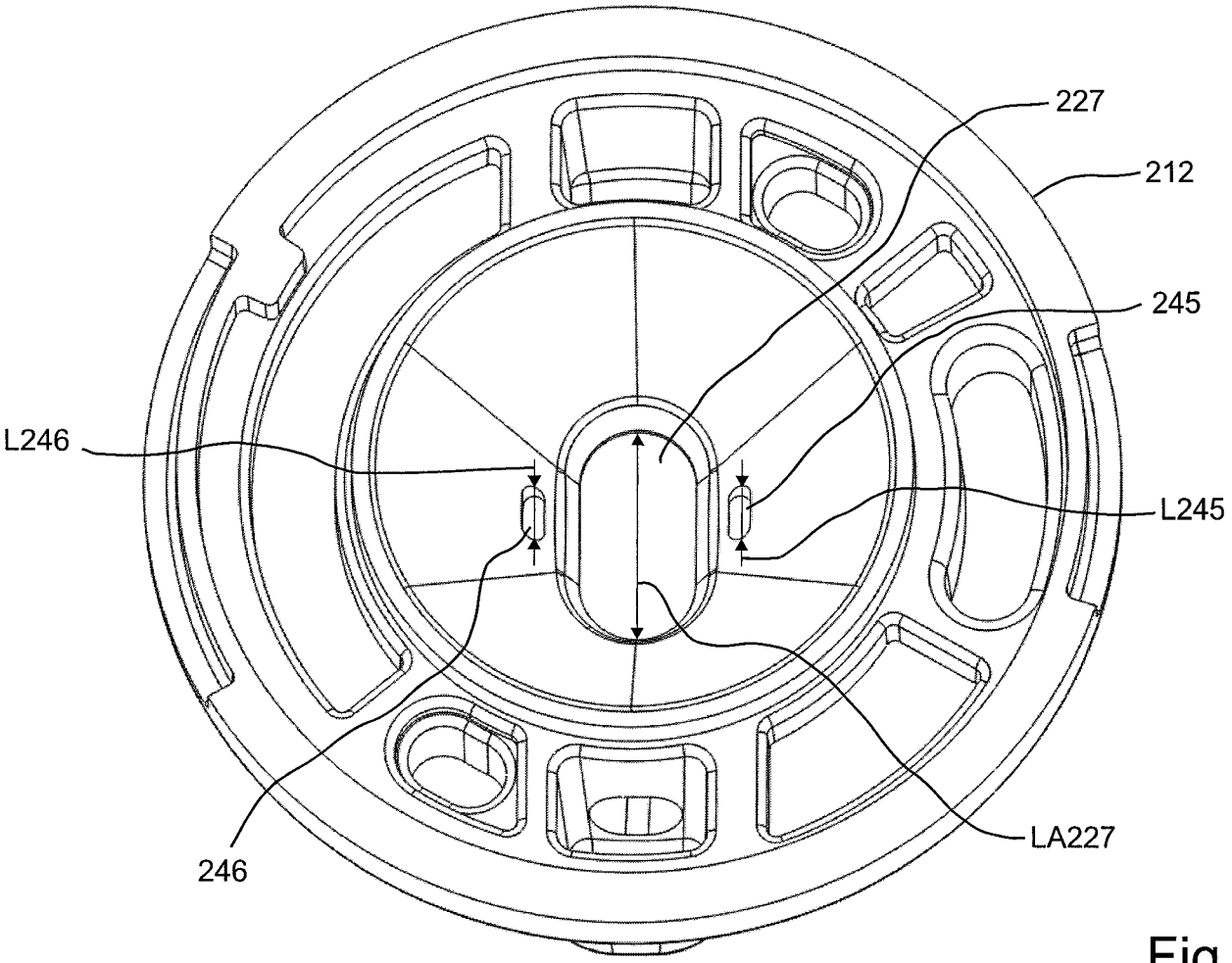

FIGS. 2*a* to 2*c* show various views of a second embodiment variant of an air cap 212 for the spray head 2 shown in FIGS. 1*a* to 1*c*. The air cap 212 is suitable for installation with the other components known from FIGS. 1*a* to 1*c* and belonging to the paint sprayer shown there.

The air cap 212 comprises a through-opening 227, two air horns 228, 229 with horn air channels 230, 231, relief bores 239, 240, curtain air channels 243, 244, and an oblong hole 236 through which the extension piece 35 is guided (see FIG. 1*a*). It will be seen from the cross-sectional view in FIG. 2*b* that the curtain air channels 243, 244 generate streams of curtain air 105, 106 which are directed toward the central axis M2, since the curtain air channels 243, 244 each have, toward their outlet 245, 246, a side wall portion 243*a*, 244*a* which is tilted in the air flow direction x toward the central axis M2 of the spray head 202.

In the bottom view shown in FIG. 2*c*, it will be seen that the two curtain air channels 243, 244 and the two outlets 244, 245 of the curtain air channels 243, 244 are arranged symmetrically with respect to a longitudinal axis LA227 of the through-opening 227. The outlets 245, 246 have lengths L245 and L246 measured parallel to the longitudinal axis LA227, these being about a quarter of a length L227 of the longitudinal axis LA227 of the through-opening 227.

FIGS. 3*a* to 3*h* show a third embodiment variant of an air cap 312, the latter in part being shown together with a control disk 311 adapted to it. In principle, the air cap 312 and the control disk 311 are intended to be installed in a paint sprayer of the kind shown schematically in FIG. 1. Here, provision is made that the control disk 311 is either actuated directly on an extension piece (not shown) or actuated indirectly, as shown in FIG. 1*a*, by a slide or a comparable component, in order to be rotated to the three different switch positions explained below.

Figure 3A:
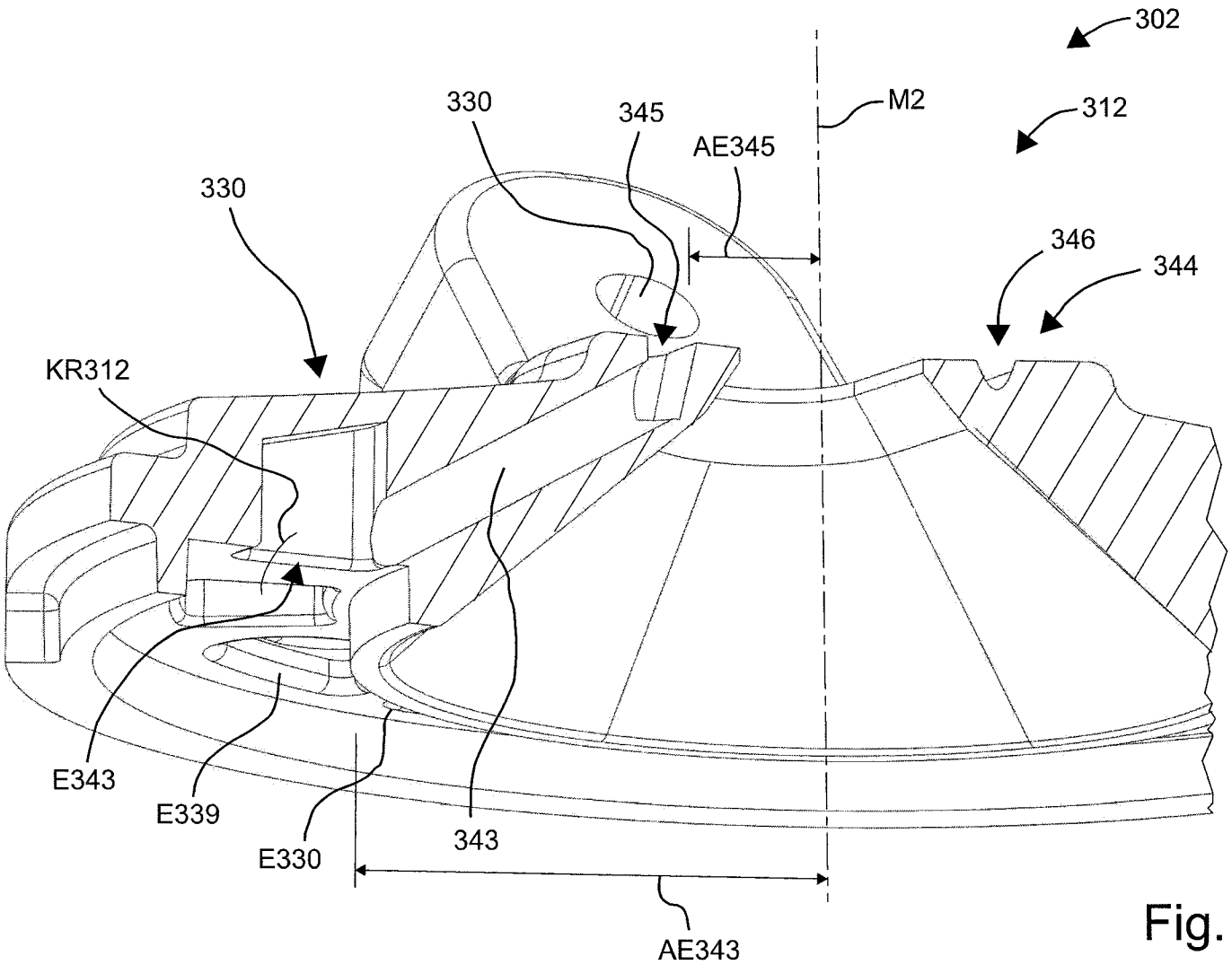
FIGS. 3*a*-3*h* show views of a third embodiment variant of an air cap, wherein the latter is shown partially together with an associated control disk, and wherein the control disk is in different rotation positions with respect to the air cap.

FIG. 3*a* shows a cross-sectional and perspective view of the air cap 312 for a spray head 302. The cross section reveals that a curtain air channel 343 does not pass through the air cap 312 like a rectilinear bore as in the first and second embodiment variants, but is instead designed as a curtain air channel 343 with a radial extent, viewed in relation to the central axis M2. A distance A345, at which an outlet 345 of the curtain air channel 343 is set apart from the central axis M2, is thus shorter than a distance AE343 at which an inlet E343 of the curtain air channel 343 is set apart from the central axis M2. The inlet E343 of the curtain air channel 343 is thus arranged, like an inlet E330 of a horn air channel 330 and an inlet E339 of a relief bore 339, on a circular ring KR312 (only indicated) about the central axis M2. This affords the possibility of also switching the curtain air channel 343 by means of the control disk 311 (see FIG. 3*b*). A second curtain air channel 344, only discernible in FIG. 3*a* from a cutout of an outlet 346, is designed with mirror symmetry to the curtain air channel 343 in relation to the central axis M2 and likewise comprises an inlet E344 (see FIG. 3*b*). For better understanding, reference is moreover made to FIG. 3*h* which shows a perspective view of the air cap 312 obliquely from above.

Figure 3B:
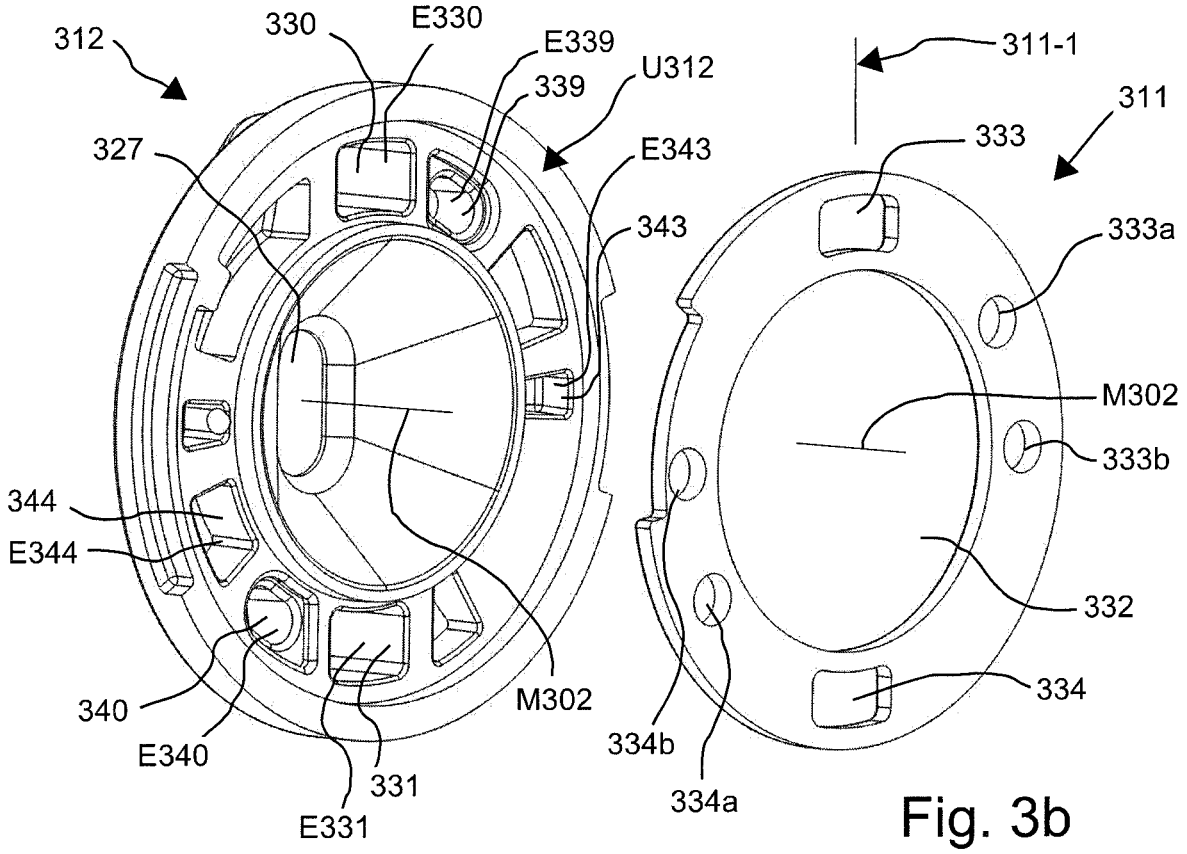
Figure 3C:
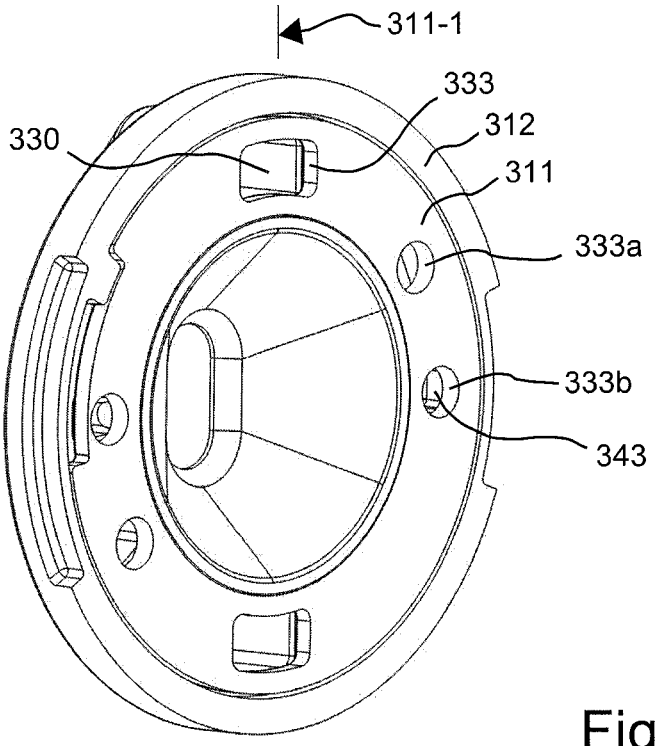
Figure 3D:
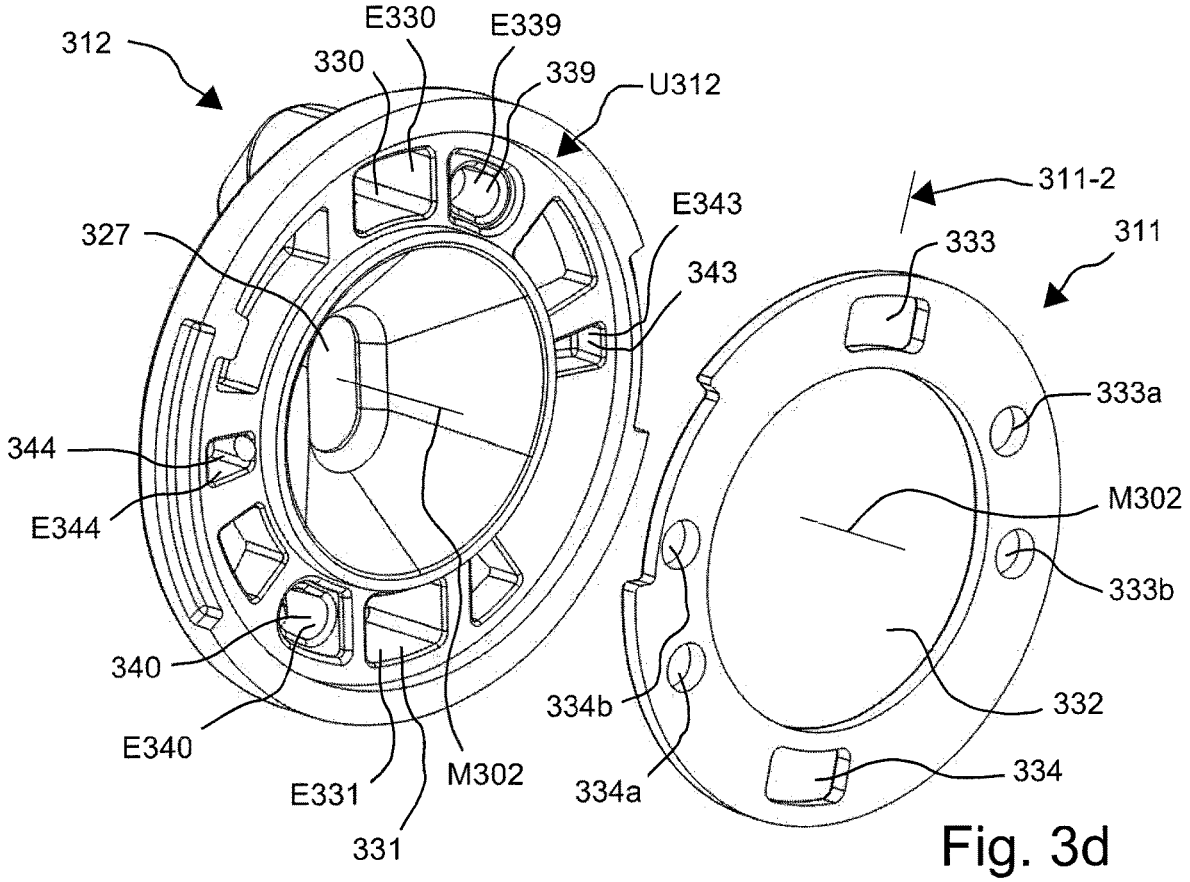
Figure 3E:
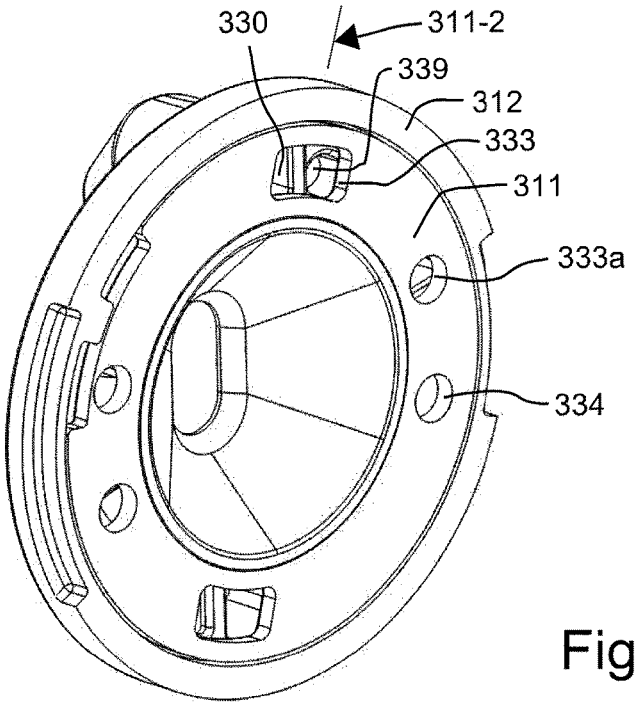
Figure 3F:
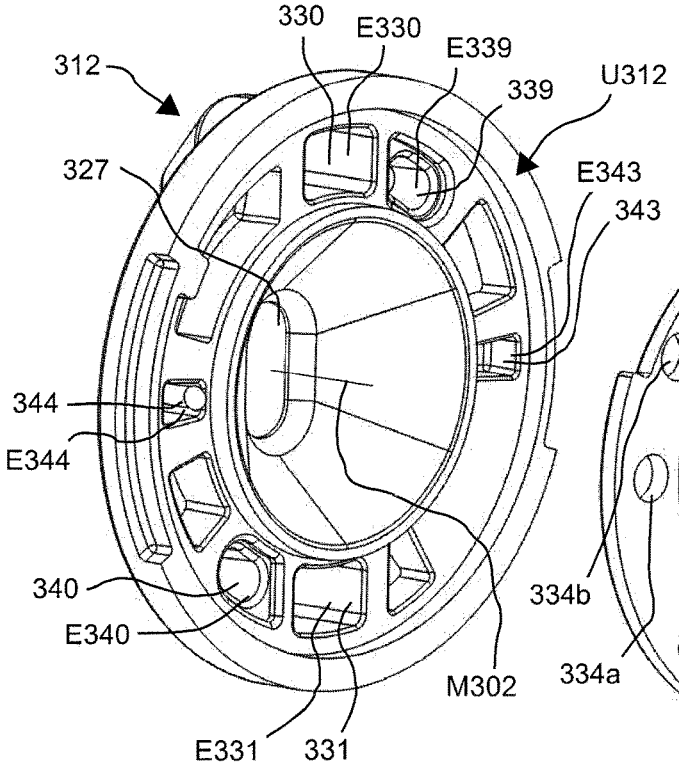
Figure 3F:
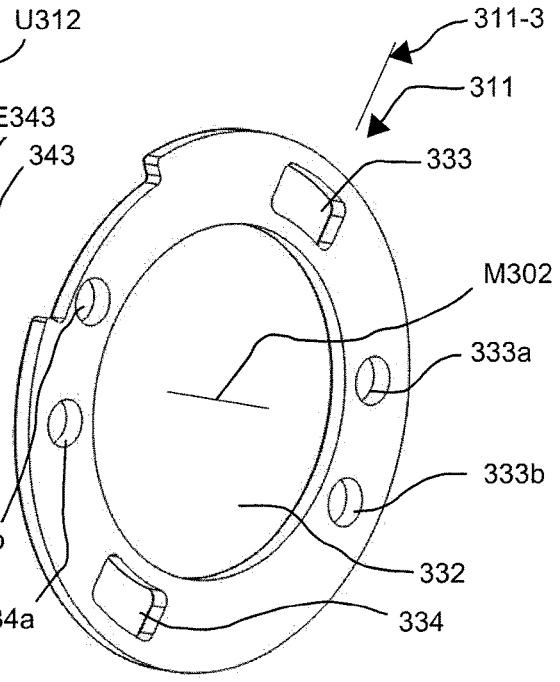

The groups of FIGS. 3*b* and 3*c*, 3*d* and 3*e*, 3*f* and 3*g* in each case show the air cap 312 and the control disk 311, wherein the control disk in the three groups of figures is shown in a first rotation position 311-1, in a second rotation position 311-2 and in a third rotation position 311-3. Here, the air cap 312 always assumes the same rotation position in all of FIGS. 3*b* to 3*g*. In FIGS. 3*b*, 3*d* and 3*f*, the air cap 312 and the control disk 311 are always shown separately from each other, while in FIGS. 3*c*, 3*e* and 3*g*, the air cap 312 and the control disk 311 are always shown assembled.

The inlet E343 of the curtain air channel 343, the inlet E339 of the relief bore 339 and the inlet E330 of the horn air channel 330 are discernible in the view of an underside U312 of the air cap 312, as can be seen in FIGS. 3*b*, 3*d* and 3*f*. A pocket, which has no particular function, lies between the inlets E343 and E339. In relation to a central axis M302, an inlet E344 of the curtain air channel 344, an inlet E340 of a relief bore 340 and an inlet E331 of a horn air channel 331 lie opposite the aforementioned inlets.

In addition to an aperture 332 arranged centrally in relation to the central axis M302, the control disk 311 has two eccentrically arranged apertures 333, 334 lying opposite each other. Moreover, two mutually opposite apertures 333*a*, 334*a* and 333*b*, 334*b*, respectively, are formed in the control disk 311 at the same radial distances from the central axis M302. In all rotation positions of the control disk 311, a through-opening 327 of the air cap 312 is supplied with air via the aperture 332.

As can be seen from comparison of FIGS. 3*b* and 3*c*, the horn air channels 330, 331 are supplied with air via the apertures 333, 334 in the first rotation position 311-1. Moreover, the curtain air channels 343, 344 are supplied with air via the apertures 333*b*, 334*b*. The relief bores 339, 340 are closed by the control disk 311. In this rotation position 311-1, with the air made available by an air supply unit, a maximum shaping effect is exerted on an emerging flat jet.

As can be seen from comparison of FIGS. 3*d* and 3*e*, the horn air channels 330, 331 and the relief bores 339, 340 are supplied with air via the apertures 333, 334 in the second rotation position 311-2. Moreover, the curtain air channels 343, 344 are closed by the control disk 311. In the second rotation position 311-2, the shutting-off of the curtain air channels 343, 344 is compensated by the opening of the relief bores 339, 340, such that the horn air channels 330, 331 receive a comparable supply of air as in the first rotation position 311-1.

Figure 3G:
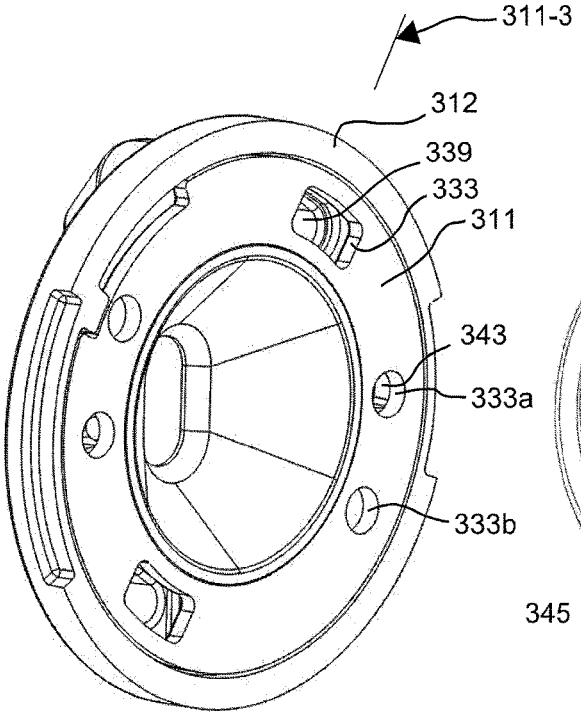
Figure 3H:
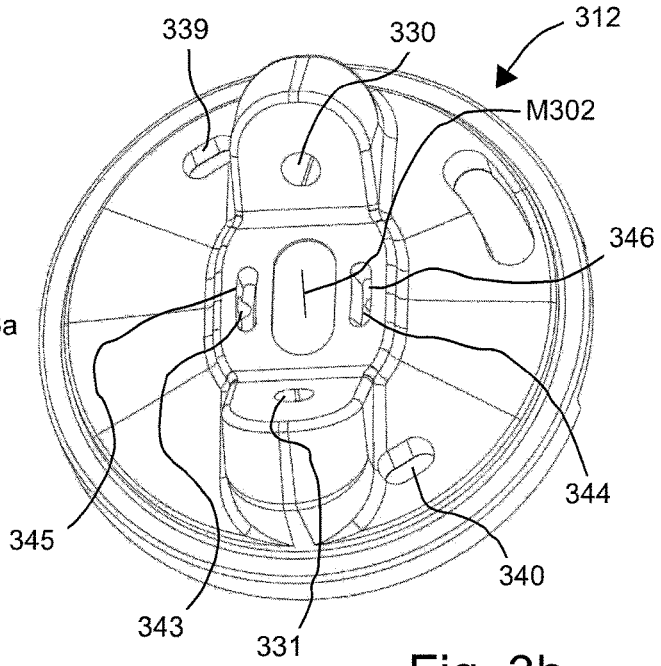

As can be seen from comparison of FIGS. 3*f* and 3*g*, the horn air channels 330, 331 are closed by the control disk 311 in the third rotation position 311-3. The curtain air channels 343, 344 and the relief bores 339, 340 are supplied with air via the apertures 333, 334 and 333*a*, 334*a*, respectively. In the third rotation position 311-3, the shutting-off of the horn air channels 330, 331 is compensated by the opening of the relief bores 339, 340, such that the curtain air channels 343, 344 receive a comparable supply of air as in the first rotation position 311-1. As can be seen from FIG. 3*h*, the outlets 345, 346, in a plan view of the air cap 312, have a profile that curves in an arc shape about the central axis M302.

Figure 6:
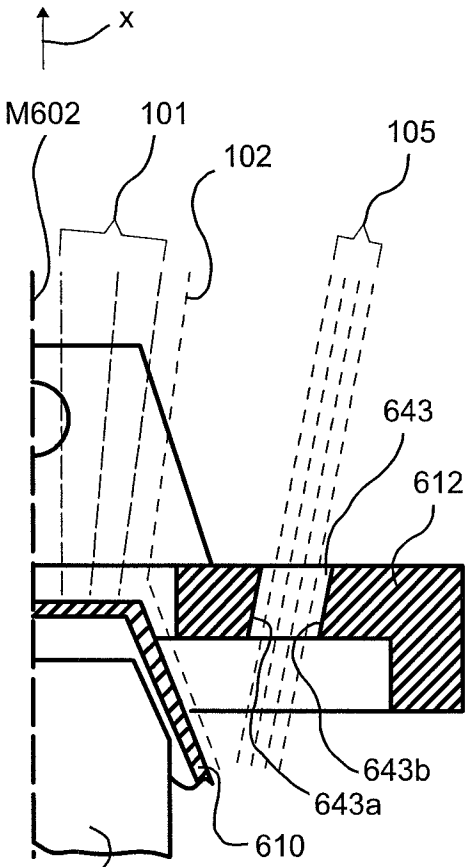
FIG. 6 shows a sixth embodiment variant of an air cap in a schematic cross-sectional view, wherein an associated air gate and an associated needle are each also shown in part.
Figure 5:
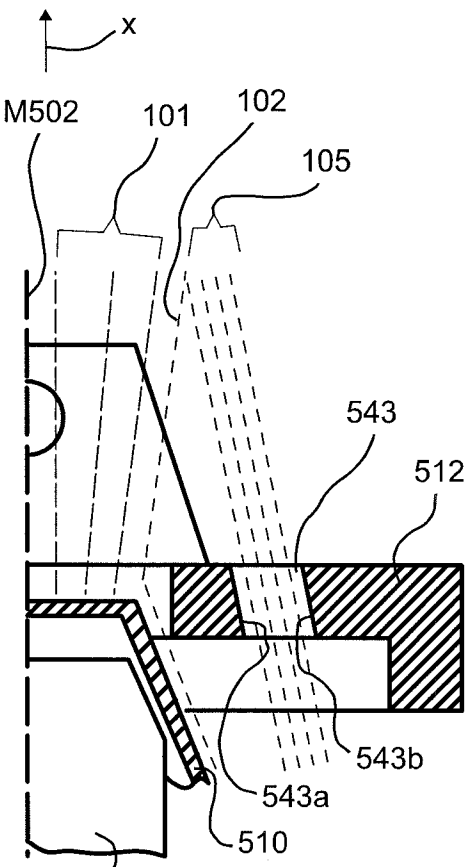
FIG. 5 shows a fifth embodiment variant of an air cap in a schematic cross-sectional view, wherein an associated air gate and an associated needle are each also shown in part.
Figure 4:
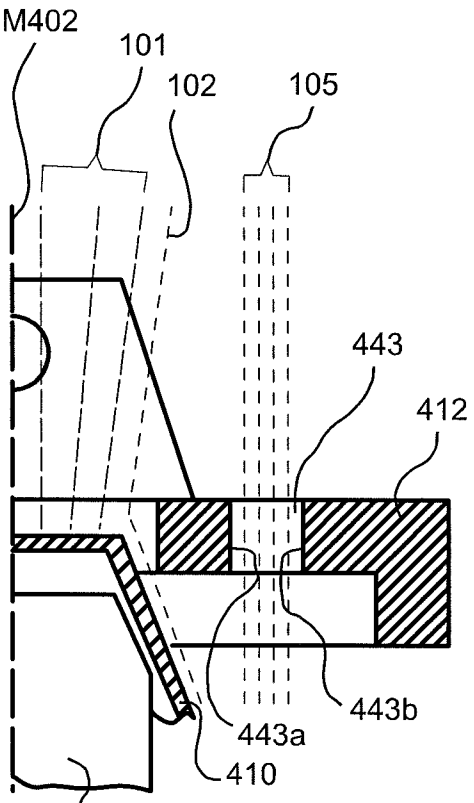
FIG. 4 shows a fourth embodiment variant of an air cap in a schematic cross-sectional view, wherein an associated air gate and an associated needle are each also shown in part.

FIGS. 4, 5 and 6 show a fourth, a fifth and a sixth embodiment variant of an air cap 412, 512 and 612 in a schematic cross-sectional view, each figure also showing part of an associated air gate 410, 510 and 610 and of an associated needle 409, 509 and 609. The component parts shown are depicted in only one half in relation to a central axis M402, M502 and M602 of a spray head in which the respective air cap 412, 512 and 612 is used. Broken lines in each case also indicate a paint jet 101, a stream of sheathing air 102 surrounding the paint jet 101, and a stream of curtain air 105 shaping the paint jet 101. The fourth, fifth and sixth embodiment variants of the air cap 412, 512 and 612, respectively, differ from each other in terms of the orientation of the streams 105 of curtain air generated and in terms of the shape or orientation of their curtain air channels 443, 543, and 643.

In the fourth embodiment variant of the air cap 412, the curtain air channels 443 generate streams of curtain air 105 oriented parallel to the central axis M402, wherein a second curtain air channel is arranged, in analogy to the first to third embodiment variants, lying opposite the curtain air channel 443 in relation to the central axis M402. For this purpose, the curtain air channels 443 have, toward their outlet 445, side wall portions 443*a*, 443*b* which are oriented parallel to the central axis M402. Accordingly shaped curtain air channels 443 influence the paint jet 101 moderately.

In the fifth embodiment variant of the air cap 512, the curtain air channels 543 generate streams of curtain air 105 oriented parallel to the central axis M502, wherein a second curtain air channel is arranged, in analogy to the first to third embodiment variants, lying opposite the curtain air channel 543 in relation to the central axis M502. For this purpose, the curtain air channels 543 have, toward their outlet 545, side wall portions 543*a*, 543*b* which are tilted in an air flow direction x toward the central axis M502. Accordingly, shaped curtain air channels 543 influence the paint jet 101 strongly.

In the sixth embodiment variant of the air cap 612, the curtain air channels 643 generate streams of curtain air 105 oriented parallel to the central axis M602, wherein a second curtain air channel is arranged, in analogy to the first to third embodiment variants, lying opposite the curtain air channel 643 in relation to the central axis M602. For this purpose, the curtain air channels 643 have, toward their outlet 645, side wall portions 643*a*, 643*b* which are tilted in an air flow direction x away from the central axis M602. Accordingly, shaped curtain air channels 643 influence the paint jet 101 weakly.

LIST OF REFERENCE SIGNS

1 paint sprayer
2 spray head
3 paint supply
4 container
5 air supply
6 fan
7 group of components
8 body
9 needle
9*a* head
10 air gate
11 control disk
12 air cap
13 union nut
14 rotary actuator
14*a*, 14*b* driver of 14
15 slide
16 trigger lever
17 trigger
18 seat on 8 for 10
19 paint outlet opening of 10
19*a* paint nozzle on 10
20-23 air outlet opening of 10
24 air supply channel in 8
25 needle valve
26 paint supply channel
27 through-opening of 12
28, 29 air horn
30, 31 horn air channel
32 central aperture in 11
33, 34 eccentric aperture in 11
35 pin-shaped extension piece of 11
36 arc-shaped oblong hole in 12
37 thread on 8 as attachment means
38 attachment means on 8
38*a* attachment means on 8 for 3
38*b* attachment means on 8 for 5
39, 40 relief bores in 12
41 front part of 9
42 rear part of 9
43 curtain air channel in 12
44 curtain air channel in 12
45 outlet of 44
46 outlet of 45
B27 width of 27
B45, B46 outlet width of 45, 46
LA27 longitudinal axis of 27
L27 length of 27
L45, L46 outlet length of 45, 46
M2 central axis of 2
QA27 transverse axis of 27
U312 underside of 312
x air flow direction
101 paint jet
102 stream of sheathing air from 27
103 stream of horn air from 28
104 stream of horn air from 29
105 stream of curtain air from 43 or 45
106 stream of curtain air from 44 or 46
202 spray head
212 air cap
227 through-opening in 212
228, 229 air horn of 212
230, 231 horn air channel in 212
236 oblong hole in 212
239, 240 relief bore in 212
243, 244 curtain air channel in 212
245, 246 outlet of 243, 244
243*a*, 243*a* side wall portion of 243, 244
LA227 longitudinal axis of 227
L227 length of 227
L245 length of 245, 246
302 spray head
311 control disk
311-1 first rotation position of 311
311-2 second rotation position of 311
311-3 third rotation position of 311
312 air cap
327 through-opening in 312
330 horn air channel in 312
331 horn air channel in 312
332 centrally arranged aperture in 311
333, 334 eccentrically arranged aperture in 311

333*a*, 334*a* aperture in 311
333*b*, 334*b* aperture in 311
339 relief bore in 312
340 relief bore in 312
343, 344 curtain air channel in 312
345, 346 outlet of 343, 344
AE343 distance between inlet E343 and central axis M2
AE345 distance between outlet 345 and central axis M2
E330 inlet of 330
E331 inlet of 331
E339 inlet of 339
E340 inlet of 340
E343 inlet of 343
E344 inlet of 344
KR312 circular ring
M302 central axis
409 needle
410 air gate
412 air cap
443 curtain air channels
443*a*, 443*b* side wall portion
M402 central axis
509 needle
510 air gate
512 air cap
543 curtain air channels
543*a*, 543*b* side wall portion
M502 central axis
609 needle
610 air gate
612 air cap
643 curtain air channels
643*a*, 643*b* side wall portion
M602 central axis

The invention claimed is:

1. A spray head for a paint sprayer, for generating a paint jet, wherein the spray head comprises an air gate, an air cap and a needle, wherein the air cap is arranged downstream from the air gate in an air flow direction, wherein the needle is arranged upstream from the air gate in the air flow direction, wherein the air gate comprises a centrally arranged paint outlet opening and air outlet openings, wherein a paint nozzle is formed by the paint outlet opening and, with the needle, forms a needle valve, wherein the air cap has a centrally arranged through-opening of elongate cross section for the passage of the paint jet or of the paint nozzle and for the passage of a stream of sheathing air surrounding the paint jet or the paint nozzle, wherein the through-opening is oriented with a substantially longitudinal axis and a substantially horizontal axis, each of the substantially longitudinal axis and the substantially horizontal axis being transverse to a central axis of the spray head running in the air flow direction, wherein the air cap comprises two air horns, each air horn protruding past the through-opening in the air flow direction and being defined spaced apart from each other on opposite sides of the through-opening along the substantially horizontal axis, wherein the air horns each comprise at least one horn air channel directed toward the paint jet emerging from the paint outlet opening, wherein each at least one horn air channel receives air via at least one of the air outlet openings of the air gate, wherein the air cap comprises two curtain air channels, each curtain air channel having an outlet arranged between the air horns, the outlets being defined opposite each other on opposite sides of the through-opening along the substantially horizontal axis, wherein the outlets of each of the curtain air channels have an outlet length substantially parallel to the substantially longitudinal axis of between 70% and 90% of a length of the through-opening of the air cap, and wherein the outlets of each of the curtain air channels have an outlet width substantially parallel to the substantially horizontal axis of at most 50% of the respective outlet length of the outlet of each of the curtain air channels.

2. The spray head as claimed in claim 1, wherein the spray head further comprises a control disk, wherein the control disk is arranged between the air gate and the air cap and is one of rotatable about the central axis of the spray head with respect to the air gate and the air cap, or is rotatable together with the air cap with respect to the air gate through an approximately 90° rotation of the air cap about the central axis of the spray head.

3. The spray head as claimed in claim 2, wherein the control disk comprises at least one aperture for sheathing air, wherein the aperture for sheathing air is arranged centrally in the control disk, and/or the control disk comprises at least one aperture for horn air, wherein the at least one aperture for horn air is arranged eccentrically in the control disk, and/or the control disk comprises at least one aperture for curtain air, wherein the aperture for curtain air is either arranged one of centrally in the control disk, or eccentrically in the control disk, and, in the case of an eccentric arrangement of the aperture for curtain air, an inlet of at least one of the curtain air channels is arranged radially farther away from the central axis of the spray head than an outlet of the at least one of the curtain air channels is arranged from the central axis of the spray head, or the control disk comprises at least one aperture for compensating air arranged eccentrically at the control disc.

4. The spray head as claimed in claim 2, wherein two of the apertures of the control disk are dimensioned such that one of the horn air channels and one of the relief bores can be supplied through these, respectively.

5. The spray head as claimed in claim 1, wherein the outlets of each of the curtain air channels is arranged with mirror symmetry to the substantially longitudinal axis of the through-opening of the air cap.

6. The spray head as claimed in claim 1, wherein the outlets of each of the curtain air channels, are curved about the central axis of the spray head.

7. The spray head as claimed in claim 1, wherein each of the curtain air channels are configured to generate streams of curtain air oriented substantially parallel to the central axis of the spray head, and wherein each of the curtain air channels have, proximate each respective outlet thereof, at least one side wall portion oriented substantially parallel to the central axis of the spray head.

8. The spray head as claimed in claim 1, wherein the curtain air channels generate streams of curtain air directed toward the central axis, wherein the curtain air channels each have, toward their outlet, at least one side wall portion which is tilted in the air flow direction toward the central axis of the spray head.

9. The spray head as claimed in claim 1, wherein the curtain air channels generate streams of curtain air directed away from the central axis, wherein the curtain air channels each have, toward their outlet, at least one side wall portion which is tilted in the air flow direction away from the central axis of the spray head.

10. The spray head as claimed in claim 1, wherein at least one aperture for horn air, at least one aperture for compensating air, and at least one aperture for curtain air are arranged on the control disk in such a way that one of, in a first rotation position adopted by the control disk relative to the air cap, air flows out of the horn air channels, relief bores for compensating air present in the air cap are cut off from an air stream, and air flows out of the curtain air channels, in a second rotation position adopted by the control disk relative to the air cap, air flows out of the horn air channels, air flows out of relief bores for compensating air that is present in the air cap, and the curtain air channels are cut off from the air stream, or in a third rotation position adopted by the control disk relative to the air cap, the horn air channels are cut off from the air stream, air flows out of relief bores for compensating air that is present in the air cap, and air flows out of the curtain air channels.

11. The spray head as claimed in claim 1, wherein a length of the substantially longitudinal axis of the centrally arranged through-opening of the air cap is at least 30% longer than a width, measured in a direction of the substantially horizontal axis, of the centrally arranged through-opening of the air cap.

12. The spray head as claimed in claim 1, wherein the spray head comprises a body and a union nut, wherein the needle is guided longitudinally displaceably in the body, wherein the body comprises a seat for the air gate, wherein the body comprises, in a region of the seat, an attachment securing the union nut in such a way that at least one of the air horns and a control disk and the air gate are held on the body, wherein the spray head comprises a rotary actuator by which the air cap is rotatable, and wherein the spray head comprises a slide guided on the rotary actuator and by which the control disk is rotatable.

13. A paint sprayer comprising a spray head according to claim 1, a paint supply and an air supply.

14. The paint sprayer as claimed in claim 13, wherein a body of the spray head comprises a first attachment attaching the paint supply thereto, a second attachment attaching the air supply thereto, and a trigger controlling spray of the paint sprayer.

* * * * *